US009149091B2

(12) United States Patent
Ishii

(10) Patent No.: US 9,149,091 B2
(45) Date of Patent: Oct. 6, 2015

(54) BUCKLE

(75) Inventor: Taiyo Ishii, Jongli (TW)

(73) Assignee: NIFCO INC., Yokohama-Shi, Kanagawa (JP)

( * ) Notice: Subject to any disclaimer, the term of this patent is extended or adjusted under 35 U.S.C. 154(b) by 356 days.

(21) Appl. No.: 13/522,212

(22) PCT Filed: Jan. 20, 2011

(86) PCT No.: PCT/JP2011/051007

§ 371 (c)(1),
(2), (4) Date: Aug. 28, 2012

(87) PCT Pub. No.: WO2011/093206

PCT Pub. Date: Aug. 4, 2011

(65) Prior Publication Data

US 2012/0324686 A1 Dec. 27, 2012

(30) Foreign Application Priority Data

Jan. 26, 2010 (JP) ..... 2010-013952

(51) Int. Cl.
*A44B 11/12* (2006.01)
*A44B 11/14* (2006.01)

(52) U.S. Cl.
CPC ..... *A44B 11/12* (2013.01); *Y10T 24/2192* (2015.01)

(58) Field of Classification Search
CPC .... B65D 63/16; B65D 63/14; B65D 63/1018; A41F 9/007; A44B 11/125; A44B 11/12; A44B 11/04
USPC ..... 24/168, 170, 185, 182, 191, 265 BC, 24/265 R, 68 E
See application file for complete search history.

(56) References Cited

U.S. PATENT DOCUMENTS

| | | | | |
|---|---|---|---|---|
| 2,981,993 | A | 5/1961 | Elsner | |
| 3,686,715 | A | 8/1972 | Brodnicki | |
| 4,171,555 | A | 10/1979 | Bakker et al. | |
| 4,414,713 | A * | 11/1983 | Prete, Jr. | 24/193 |
| 5,641,166 | A * | 6/1997 | Reisel | 273/261 |
| 5,651,166 | A | 7/1997 | Lundstedt | |

FOREIGN PATENT DOCUMENTS

| | | |
|---|---|---|
| JP | S36-21375 | 11/1961 |
| JP | S63-75209 | 5/1988 |

OTHER PUBLICATIONS

Taiwanese Patent Office, "Office Action for TW 100101723", Jul. 10, 2013.

* cited by examiner

*Primary Examiner* — Jack W Lavinder
(74) *Attorney, Agent, or Firm* — Manabu Kanesaka

(57) ABSTRACT

A buckle has a pair of side frame portions; first and second crossbars extending between the pair of side frame portions; a fastening portion disposed on at least one portion of the buckle for fastening a belt-like body. The fastening portion includes a clamping member rotatably supported in the side frame portions, and sandwiching the belt-like body between a free end portion and the first crossbar in a rotating position wherein the free end portion is most closely contacting with the first crossbar from the front surface side of the buckle; and holding devices generating an elastic deformation against a rotation in the clamping member relative to the rotation of the clamping member in a direction of separating the free end portion from the first crossbar.

7 Claims, 6 Drawing Sheets

BUCKLE

FIELD OF TECHNOLOGY

The present invention relates to an improvement of a buckle comprising a fastening portion provided on at least one portion of the buckle for fastening a belt-like body by inserting the belt-like body to pass through.

BACKGROUND ART

There is a buckle including a pair of side frame portions, and a first crossbar and a second crossbar ranged between the pair of side frame portions. The buckle is provided with the fastening portion fastening the belt-like body when the belt-like body is wound around the first crossbar in such a way that once the belt-like body is inserted to pass between the pair of side frame portions from a back surface side, and is pulled out of a front surface side, the belt-like body is pulled out of the back surface side again by passing between the first crossbar and the second crossbar. (See Patent Document 1 and Patent Document 2)

Such buckle includes a function in which the more a tensional force acts on the belt-like body which has been inserted to pass through, the more a fastening force relative to the belt-like body is strengthened. On the other hand, in such buckle, if the tensional force acting on the belt-like body stops, or has been reduced, the second crossbar is not strongly pressed against a pulled-out portion of the belt-like body so as to become a state wherein a variation in a fastening position relative to the belt-like body can occur. Typically, if the belt-like body fastened to the buckle, and tightening a specific portion (for example, a hip or a chest) of a body or a specific portion (for example, a bag portion of a backpack) of an article, moves from the specific portion by walking, transportation, and the like to thereby cause a slight loosening in the belt-like body, the fastening position of the buckle relative to the belt-like body varies to cause further loosening in the belt-like body.

PRIOR ART DOCUMENT

Patent Document

Patent Document 1: Japanese Patent No. 4159447

Patent Document 2: Japanese Examined Patent Publication No. H06-14881

SUMMARY OF THE INVENTION

Problems to be Solved by the Invention

A main problem to be solved by the present invention is that in this kind of buckle, even if the tensional force stops acting on the belt-like body which is a fastening subject matter, or has been reduced, the fastening position of the buckle relative to the belt-like body can be maintained.

Means for Solving the Problems

In order to achieve the aforementioned object, the present invention is a buckle including a pair of side frame portions, and a first crossbar and a second crossbar extending between the pair of side frame portions. The buckle comprises a fastening portion provided on at least one portion of the buckle for fastening a belt-like body when the belt-like body is wound around the first crossbar in such a way that once the belt-like body is inserted to pass between the pair of side frame portions from a back surface side, and is pulled out of a front surface side, the belt-like body is pulled out of the back surface side again by passing between the first crossbar and the second crossbar. The fastening portion comprises a clamping member rotatably supported in the side frame portions, and also clamping the belt-like body between a free end portion and the first crossbar in a rotating position wherein the free end portion is most closely contacting the first crossbar from the front surface side of the buckle; and a holding device generating an elastic deformation in the clamping member against a rotation of the clamping member relative to the rotation of the clamping member in a direction of separating the free end portion from the first crossbar.

When the belt-like body is wound around the first crossbar by passing under a bar back surface of the second crossbar structuring the fastening portion, and the belt-like body is pulled out of the buckle by passing under the bar back surface of the second crossbar again between both the crossbars, the second crossbar holds down such pulled-out portion of the belt-like body. The more a tensional force acts on the belt-like body, the more the second crossbar is strongly pressed against the belt-like body. Thereby, the buckle can fasten relative to an arbitrary position of the belt-like body. Also, in a state wherein the belt-like body is inserted to pass through, and is fastened to the fastening portion of the buckle in the aforementioned manner, even in a case where the tensional force stops acting on the belt-like body, or has been reduced, the clamping member can prevent the belt-like body from moving in a length direction thereof. A clamped state of the belt-like body by the clamping member is stably maintained by the holding device. As a result, even in such case, a fastening position relative to the belt-like body in the buckle can be kept steady so as not to cause a significant loosening in such belt-like body.

One of preferred embodiments is that the holding device is a protruding portion formed in the side frame portions, and abutted against one portion of the clamping member at least at a rotation time of the clamping member. In this case, it is further preferable that tapered portions are respectively formed on both sides clamping a protruding end in such protruding portion.

Also, one of the preferred embodiments is that in the clamping member, a base end portion is supported by an axis on the side frame portions, and also that the clamping member is structured by a wire material abutting against the holding device at an intermediate portion between the base end portion and the free end portion. In this case, it is further preferable that such wire material is molded in such a way as to comprise the pair of intermediate portions respectively comprising the base end portion, and the free end portion ranged between the pair of intermediate portions.

When the clamping member is rotated from the rotating position, which sandwiches the belt-like body between the first crossbar and the free end portion, in a direction of releasing the clamping of the clamping member, the intermediate portions of the clamping member contact with the holding device as the protruding portion so as to generate the elastic deformation in the clamping member. Specifically, when the clamping member which is in the rotating position is operated to rotate in the direction of releasing the aforementioned clamping, one of the tapered portions hit against the intermediate portions, so that the clamping member is gradually elastically deformed in a direction of expanding an interval between the pair of intermediate portions. Thereby, the rotation of the clamping member is allowed, and on the other hand, a state wherein the clamping member is in the rotating position is not easily released. While elastically deforming the intermediate portions in this manner, when the clamping member is rotated up to a position wherein the intermediate portions climb over the protruding end, due to an elastic return of the intermediate portions, the clamping member is forcedly rotated, so that a state of clamping the belt-like body by the clamping member is released. When the clamping member, which is in a position wherein the clamping member does not sandwich the belt-like body in this manner, is operated to rotate toward the aforementioned rotating position, the other of the tapered portions hits against the intermediate portions, so that the clamping member is gradually elastically deformed in the direction of expanding the interval between the pair of intermediate portions. Thereby, a state wherein the clamping member is in the position of not clamping the belt-like body is also not easily released.

If the wire material structuring the clamping member is molded in such a way as to comprise the pair of intermediate portions respectively comprising the base end portion, and the free end portion ranged between the pair of intermediate portions, and in such a way that the intermediate portions further comprise a winding portion, and also if the holding device is a supporting portion of the winding portion provided in the side frame portions, and supporting the winding portion at a position different from the base end portion of the wire material, when the clamping member is rotated from the rotating position, wherein the free end portion of the clamping member sandwiches the belt-like body between the free end portion and the first crossbar, in the direction of separating the free end portion from the first crossbar, the winding portion can be elastically deformed. Thereby, a state, wherein the free end portion of the clamping member sandwiches the belt-like body between the free end portion and a bar front surface of the first crossbar, can be prevented from being easily released.

Also, if a surface of the free end portion of the clamping member has a rough surface, a friction resistance between the free end portion and the belt-like body can increase so as to be capable of improving the sandwiched state of the belt-like body by the clamping member.

Effect of the Invention

In the buckle according to the present invention, even if the tensional force stops acting on the belt-like body which is a fastening subject matter, or has been reduced, due to the clamping member and the holding device thereof, the fastening position of the buckle relative to the belt-like body can be maintained, and even in such case, the significant loosening does not occur in such belt-like body.

BEST MODES OF CARRYING OUT THE INVENTION

Figure 1:
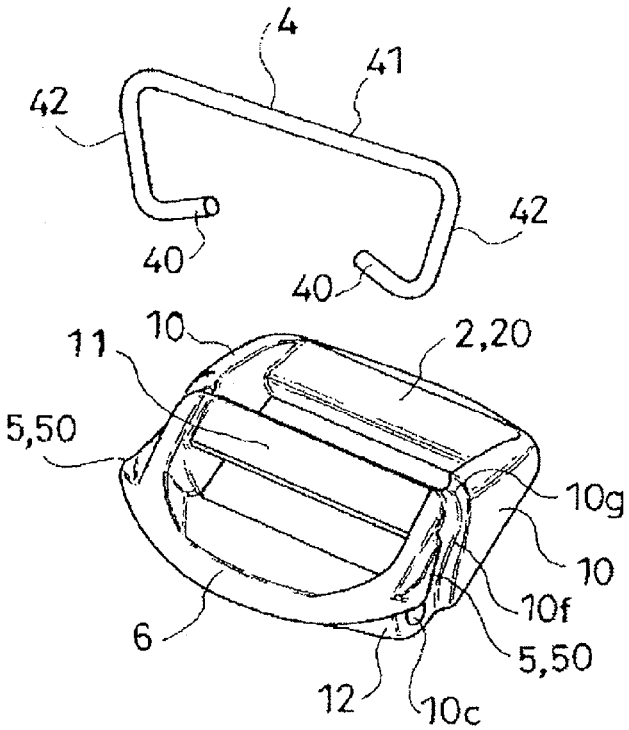
FIG. 1 is an exploded perspective view of a buckle according to the first embodiment of the present invention.
Figure 2:
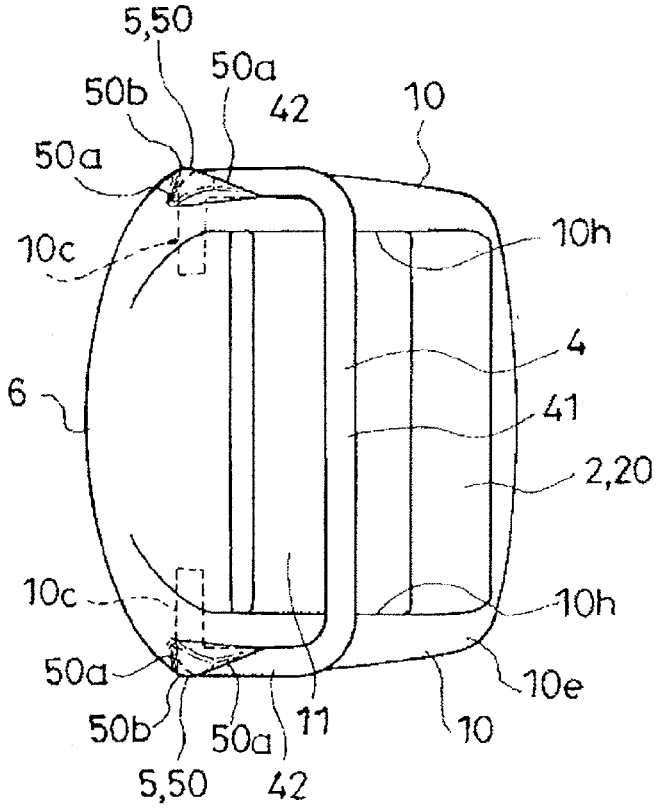
FIG. 2 is a front view of the buckle according to the first embodiment, and a clamping member is in the first rotating position.
Figure 3:
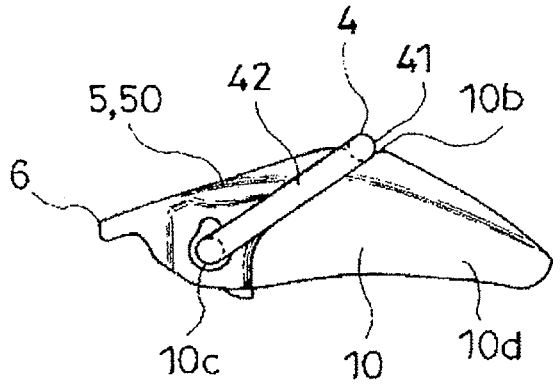
FIG. 3 is a side view of the buckle according to the first embodiment, and the clamping member is in the first rotating position.
Figure 4:
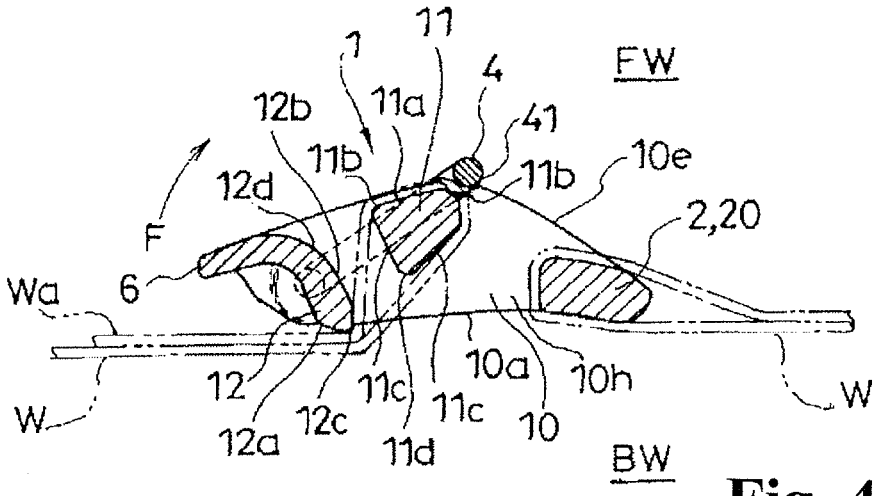
FIG. 4 is a cross-sectional view of the buckle according to the first embodiment, and the clamping member is in the first rotating position.
Figure 5:
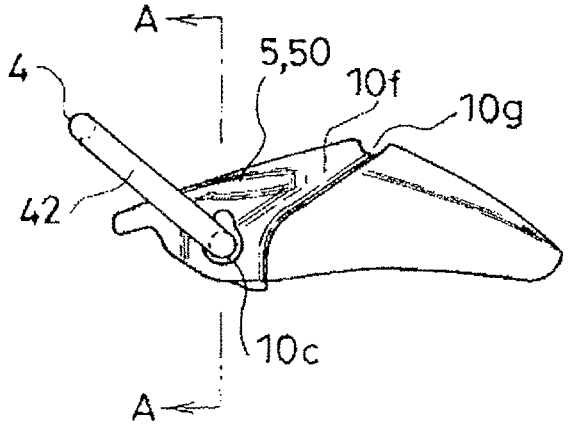
FIG. 5 is a side view of the buckle according to the first embodiment, and the clamping member is in a second rotating position.
Figure 6:
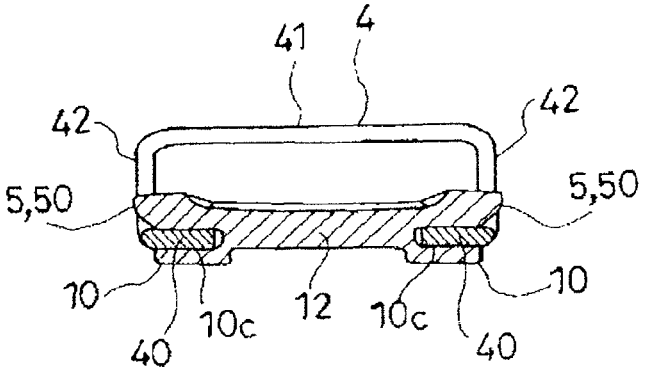
FIG. 6 is a cross-sectional view taken along a line A to A in FIG. 5.

Hereinafter, with reference to FIGS. 1 to 13, a typical embodiment of the present invention will be explained. A buckle according to the present embodiment comprises at least one portion of a fastening portion 1 fastening a belt-like body W by inserting the belt-like body W to pass through. The buckle includes a pair of side frame portions 10 and 10; a first crossbar 11 extending between the pair of side frame portions 10 and 10; and a second crossbar 12 extending between the pair of side frame portions 10 and 10 by opening an interval between the second crossbar 12 and the first crossbar 11, wherein the fastening portion 1 is located on the first cross bar 11. Also, the fastening portion 1 has a structure of fastening the belt-like body W when the belt-like body W is wound around the first crossbar 11 in such a way that once the belt-like body W is inserted to pass between the pair of side frame portions 10 and 10 from a back surface side Bw, and is pulled out of a front surface side Fw, the belt-like body W is pulled out of the back surface side Bw again by passing between the first crossbar 11 and the second crossbar 12.

Figure 9:
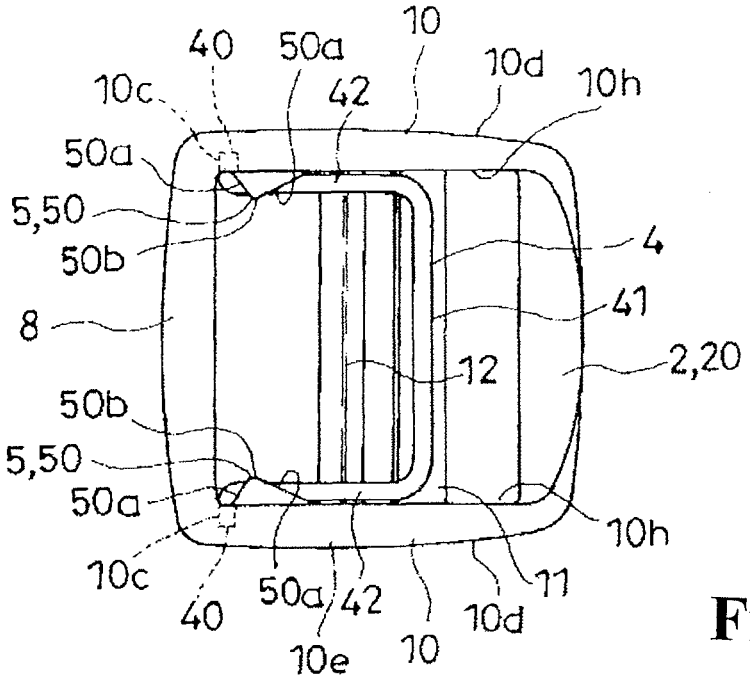
FIG. 9 is a front view of the buckle according to a third embodiment of the present invention.
Figure 10:
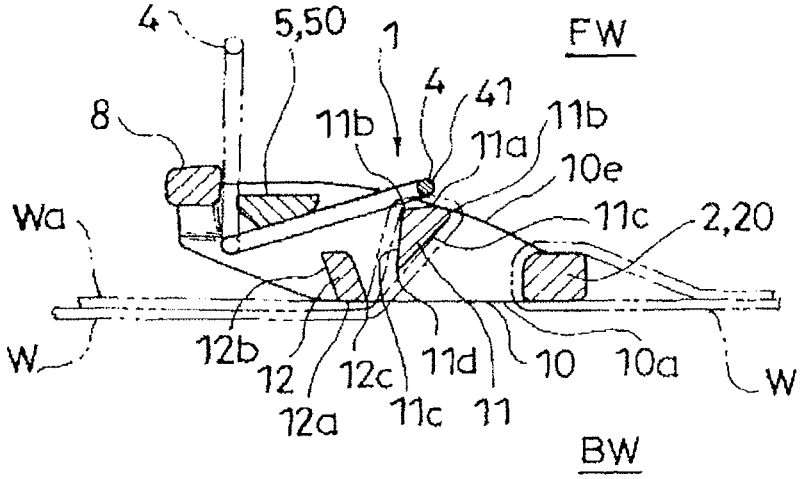
FIG. 10 is a cross-sectional view of the buckle according to the third embodiment.
Figure 11:
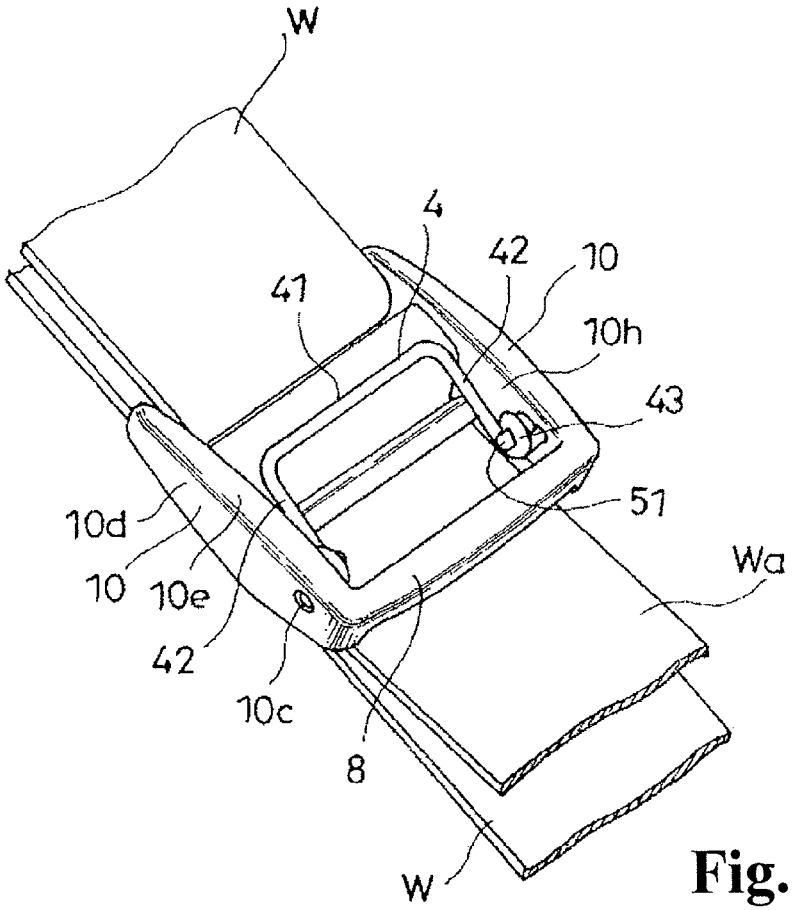
FIG. 11 is a perspective view showing a usage sate of the buckle according to a fourth embodiment of the present invention.
Figure 12:
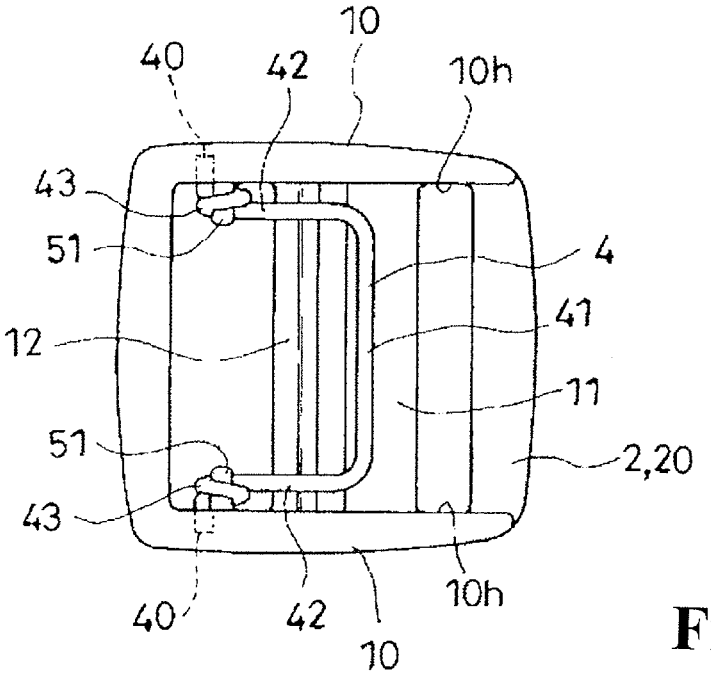
FIG. 12 is a front view of the buckle according to the fourth embodiment.
Figure 13:
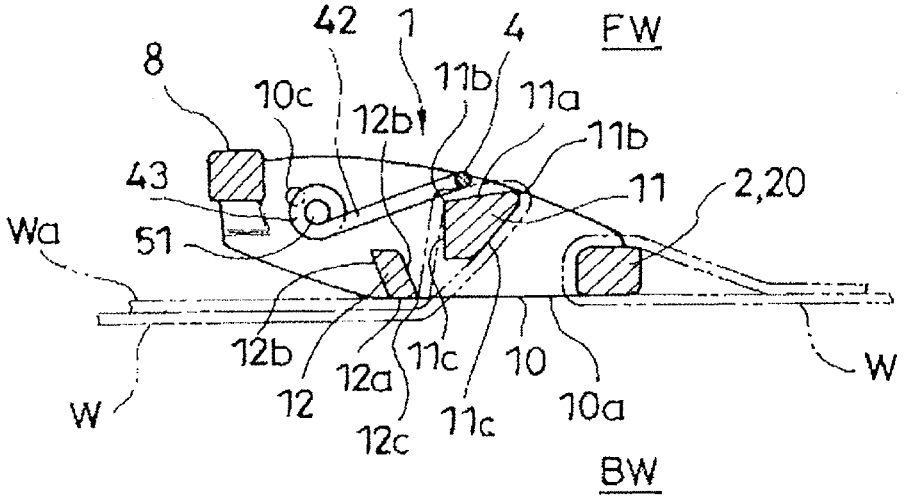
FIG. 13 is a cross-sectional view of the buckle according to the fourth embodiment.

In the first embodiment shown in FIGS. 1 to 6, a third embodiment shown in FIGS. 9 and 10, and a fourth embodiment shown in FIGS. 11 to 13, the buckle comprises one portion of such fastening portion 1, and one portion of an attachment portion 2 of the belt-like body W. Then, such buckle is structured in such a way as to connect the belt-like body W, which has been inserted to pass through the fastening portion 1, to the belt-like body W, which has been wound around the attachment portion 2, through the buckle.

Figure 7:
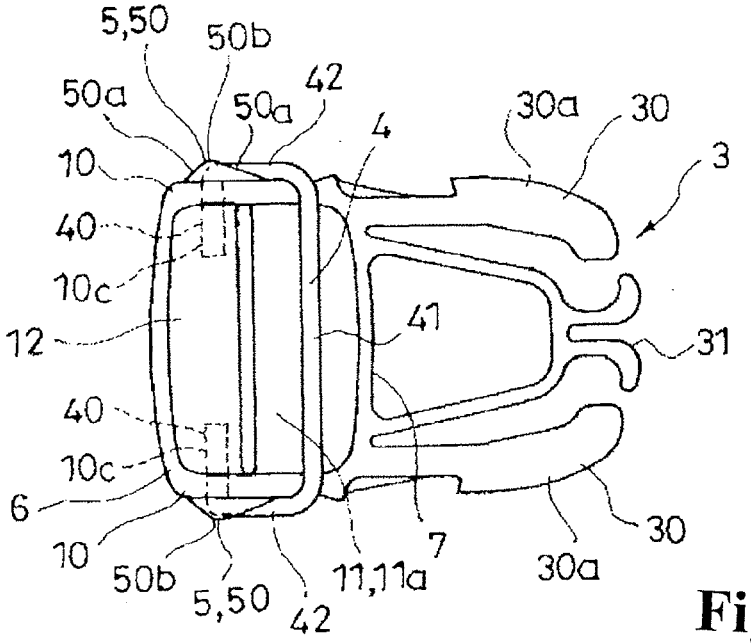
FIG. 7 is a front view of the buckle according to the second embodiment of the present invention.
Figure 8:
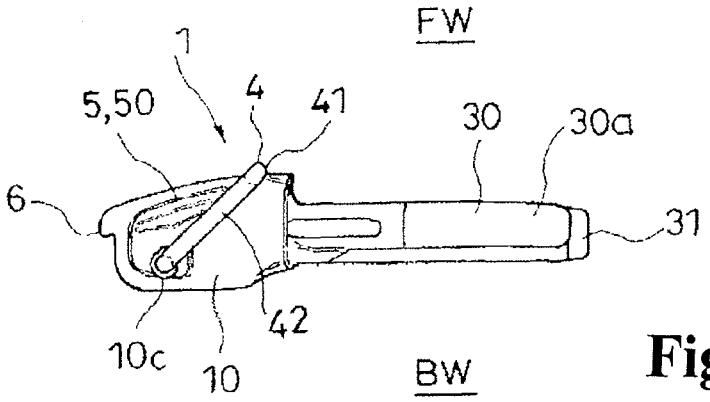
FIG. 8 is a side view of the buckle according to the second embodiment.

A second embodiment shown in FIGS. 7 and 8 is the buckle (hereinafter, called a male buckle) comprising an insertion portion 3 disengageably fitted into a female buckle which has a flattened cylinder shape and is not shown in the figures. Then, the male buckle comprises one portion of the fastening portion 1. The insertion portion 3 is structured by a right-and-left pair of elastic latch-engaging legs 30 and 30, and a middle leg 31 positioned between the pair of elastic latch-engaging legs 30 and 30. An insertion of the insertion portion 3 of the male buckle into the female buckle is allowed by inward bending of the right-and-left pair of elastic latch-engaging legs 30 and 30, and due to a bending return of the elastic latch-engaging legs 30 in the insertion-ending position, protruding portions 30*a* formed in an outside portion of the elastic latch-engaging legs 30 are inserted into latch-engaging windows formed in side portions of the female buckle so as to be latched and engaged. Then, the latch-engagement state can be released by bending the pair of elastic latch-engaging legs 30 and 30 by operating to press the protruding portions 30*a*, which have been inserted into such latch-engaging windows, from an outside. In the second embodiment, the belt-like body W which has been fastened to the fastening portion 1 of the male buckle is connected relative to a member wherein the female buckle is attached by engaging both members.

If the aforementioned fastening portion 1 is provided in the buckle with two portions or above, two or above of the belt-like bodies W can be connected through the buckle so as to be capable of adjusting a fastening position. For example, if the attachment portion 2 of the first embodiment is replaced with such fastening portion 1, two of the belt-like bodies W can be connected through the buckle of the first embodiment so as to be capable of adjusting the fastening position.

An interval approximately equal to or above a width of the belt-like body W is formed between the pair of side frame portions 10 and 10 structuring such fastening portion 1.

Both ends of the first crossbar 11 are integrally linked to frame inside surfaces 10*h* of the side frame portions 10 respectively. Also, the first crossbar 11 comprises a bar front surface 11*a* structuring one portion of a front surface of the buckle; and bar side surfaces 11*c* forming corner portions 11*b* between the bar side surfaces 11*c* and the bar front surface 11*a*. An interval between the pair of bar side surfaces 11*c* and 11*c* is made to narrow on the back surface side Bw of the buckle, and the first crossbar 11 is structured to comprise a top portion 11*d* on the back surface side Bw of the buckle. An interval is formed between the top portion 11*d* of the first crossbar 11 and a frame back surface 10*a* of the side frame portions 10 structuring one portion of a back surface of the buckle.

Both ends of the second crossbar 12 are integrally linked to the inside surfaces 10*h* of the side frame portions 10 respectively. An interval allowing the belt-like body W to pass through is formed between the second crossbar 12 and the first crossbar 11. The second crossbar 12 includes a bar back surface 12*a* structuring one portion of the back surface of the buckle. A corner portion 12*c* between a bar side surface 12*b* facing the first crossbar 11 and the bar back surface 12*a* in the second crossbar 12 has an angulated shape protruded to the belt-like body W which is inserted to pass through.

When the belt-like body W is wound around the first crossbar 11 by passing under the bar back surface 12*a* of the second crossbar 12 structuring the fastening portion 1, and the belt-like body W is pulled out of the buckle by passing under the bar back surface 12*a* of the second crossbar 12 again between both the crossbars 11 and 12, the second crossbar 12 holds down such pulled-out portion Wa of the belt-like body W in such a way as to protrude the aforementioned corner portion 12*c* of the second crossbar 12 to the belt-like body W. The more a tensional force acts on the belt-like body W, the more the second crossbar 12 is strongly pressed against the belt-like body W. Thereby, the buckle can be fastened relative to an arbitrary position of the belt-like body W. Such fastening can be released by operating the buckle in such a way that the bar back surface 12*a* of the second crossbar 12 is separated from the belt-like body W. (For example, in the first embodiment, a side of the second crossbar 12 of the buckle is lifted up in a direction of an arrow F in FIG. 4.)

Also, in the buckle according to the present embodiment, the aforementioned fastening portion 1 comprises a clamping member 4 rotatably supported in the side frame portions 10, and also clamping the belt-like body W between a free end portion 41 and the first crossbar 11 in a rotating position wherein the free end portion 41 is moved the closest to the first crossbar from the front surface side Fw of the buckle; and holding devices 5 generating an elastic deformation against a rotation in the clamping member 4 relative to the rotation of the clamping member 4 in a direction wherein the free end portion 41 is separated from the first crossbar 11.

Thereby, in the present embodiment, in a state wherein the belt-like body W is inserted to pass through, and is fastened to the fastening portion 1 of the buckle in the aforementioned manner, even in a case where the tensional force stops acting on the belt-like body W, or has been reduced, the clamping member 4 can prevent the belt-like body W from moving in a length direction thereof. A clamped state of the belt-like body W by the clamping member 4 is stably maintained by the holding devices 5. As a result, even in such case, the fastening position relative to the belt-like body W in the buckle can be kept steady so as not to cause a significant loosening in such belt-like body W. For example, even in a case wherein the belt-like body W, which is fastened to the buckle, and tightening a specific portion (for example, a hip or a chest) of a body, or a specific portion (for example, a bag portion of a backpack) of an article, moves from the specific portion by walking, transportation, and the like so as to cause a slight loosening in the belt-like body W, the present embodiment can prevent the further loosening in the belt-like body W. A change of the fastening position of the buckle relative to the belt-like body W can be carried out by operating the buckle in such a way that the bar back surface 12*a* of the second crossbar 12 is separated from the belt-like body W in a state wherein the clamping member 4 is rotated in the direction wherein the free end portion 41 is separated from the first crossbar 11 while elastically deforming the clamping member 4.

First Embodiment

In the first embodiment shown in FIGS. 1 to 6, the buckle has a structure of disposing the second crossbar 12 between one end portion of the pair of side frame portions 10 and 10; comprising a crossbar 20, which becomes the aforementioned attachment portion 2, between the other end portions of a pair of such side frame portions 10 and 10; and comprising the first crossbar 11 between both members. In the second crossbar 12, there is integrally linked a tongue piece 6 structuring one portion of the front surface of the buckle. The tongue piece 6 protrudes from a portion positioned on a front surface side of the buckle in the second crossbar 12 in a direction of separating from the first crossbar 11. Also, a protruding edge thereof structures one portion of an external outline of the buckle. In the front surface side Fw of the buckle, the pair of side frame portions 10 and 10 makes a top portion 10*b* in an approximately middle position in the length direction thereof, and the pair of side frame portions 10 and 10 is formed in such a way as to gradually narrow a size in a front-back direction of the side frame portions 10 as going to end portion sides from the top portion 10*b*.

In the first embodiment, in the clamping member 4, base end portions 40 are supported by axes on the side frame portions 10, and also the clamping member 4 is structured by a metallic wire material abutting against the holding devices 5 in intermediate portions 42 between the base end portions 40 and the free end portion 41. Also, such clamping member 4 is structured by molding the wire material in such a way as to comprise the pair of intermediate portions 42 and 42 respectively comprising the base end portion 40, and the free end portion 41 ranged between the pair of intermediate portions 42 and 42. In an illustrated example, the free end portion 41 of the wire material has a length approximately ranged between frame outside surfaces 10*d* of the pair of side frame portions 10 and 10. The intermediate portions 42 extend in a direction crossing to the free end portion 41 from the free end portion 41. The base end portions 40 are formed in terminals of the intermediate portions 42, and protrude to a side of the other intermediate portion 42 in a direction orthogonal to the intermediate portions 42. In the example, in a state before the pair of intermediate portions 42 and 42 of the wire material is attached to the side frame portions 10, the pair of intermediate portions 42 and 42 of the wire material respectively extends obliquely from the free end portion 41 in such a way as to gradually approach the other intermediate portion 42 as the pair of intermediate portions 42 and 42 of the wire material goes to the terminals thereof. (FIG. 1)

In the pair of side frame portions 10 and 10, there are respectively formed axis holes 10*c* rotatably housing the base end portions 40 of the clamping member 4. The axis holes 10*c* are open in the frame outside surfaces 10*d* of the side frame portions 10. Also, the axis holes 10*c* are linkage portions between the side frame portions 10 and the second crossbar 12, and are formed in the back surface side Bw of the buckle.

The clamping member 4 is rotatably combined with the side frame portions 10 by inserting one base end portion 40 into one axis hole 10*c* of the pair of side frame portions 10 and 10 from an outside of the side frame portion 10, and by inserting the other base end portion 40 into the other axis hole 10*c* of the pair of side frame portions 10 and 10 from the outside of the side frame portion 10. By the insertions, the intermediate portions 42 of the clamping member 4 have a structure to be elastically deformed in such a way as to be in a direction orthogonal to the free end portion 41 by the frame outside surfaces 10*d* of the side frame portions 10. Then, such clamping member 4 rotates between the rotating position (FIG. 3/hereinafter, the rotating position is called the first rotating position) wherein the free end portion 41 thereof is contacted with the corner portions 11*b* between the bar front surface 11*a* of the first crossbar 11 and the bar side surfaces 11*c* facing a crossbar 20 side, and the rotating position (FIG. 5/hereinafter, the rotating position is called a second rotating position) wherein the free end portion 41 is positioned on top of a bar front surface 12*d* of the second crossbar 12.

Also, the holding devices 5 are formed in the side frame portions 10, and also are structured as protruding portions 50 abutted against one portion of the clamping member 4 at least at a rotation time of the clamping member 4. In the example, such protruding portions 50 are respectively formed in the frame outside surfaces 10*d* of the pair of side frame portions 10 and 10. In the illustrated example, such protruding portions 50 are formed in a portion which is generally between the first crossbar 11 and the second crossbar 12 in the side frame portions 10. Also, such protruding portions 50 are structured in such a way as to form a fin shape protruding in a direction orthogonal to the frame outside surfaces 10*d* along a corner portion between a frame front surface 10*e* structuring one portion of the front surface of the buckle and the frame outside surfaces 10*d* in the side frame portions 10.

Also, in the example, both sides sandwiching protruding end 50*b* in such protruding portions 50 are respectively tapered portions 50*a*. Namely, such protruding portion 50 comprises the tapered portion 50*a* facing a first crossbar 11 side, and the tapered portion 50*a* facing a second crossbar 12 side by sandwiching the protruding end 50*b* which protrudes most from the frame outside surface 10*d* of the side frame portion 10.

Then, in the example, when the clamping member 4 is rotated in a range of moving between the first rotating position and the second rotating position, the intermediate portions 42 of the clamping member 4 contact with the holding devices 5 as the protruding portions 50 so as to generate the elastic deformation in the clamping member 4. Specifically, when the clamping member 4 which is in the first rotating position is operated to rotate toward the second rotating position, the tapered portions 50*a* hit against the intermediate portions 42, so that the clamping member 4 is gradually elastically deformed in a direction of expanding an interval between the pair of intermediate portions 42 and 42. Thereby, the clamping member 4 can rotate toward the second rotating position, and also on the other hand, a state wherein the clamping member 4 is in such first rotating position is not easily released. While elastically deforming the intermediate portions 42 in this manner, when the clamping member 4 is rotated up to a position wherein the intermediate portions 42 climb over the protruding ends 50*b*, due to an elastic return of the intermediate portions 42, the clamping member 4 is forcedly rotated up to the second rotating position, so that a state of clamping the belt-like body W by the clamping member 4 is released. When the clamping member 4 which is in the second rotating position is operated to rotate toward the first rotating position, the tapered portions 50*a* hit against the intermediate portions 42, so that the clamping member 4 is gradually elastically deformed in the direction of expanding the interval between the pair of intermediate portions 42 and 42. Thereby, a state wherein the clamping member 4 is in the second rotating position is also not easily released.

Incidentally, in the example, in the frame outside surfaces 10*d* of the side frame portions 10, there are formed depressions 10*f* housing the intermediate portions 42 when the clamping member 4 is in the first rotating position. Also, in the frame front surface 10*e*, there is formed a depression 10*g* housing the free end portion 41 when the clamping member 4 is in the first rotating position. Also, in the first rotating position in the first crossbar 11, the corner portions 11*b* in which the free end portion 41 contacts are chamfered.

Second Embodiment

In the second embodiment shown in FIGS. 7 and 8, the male buckle as the buckle has a structure in which the second crossbar 12 is disposed between one end portion of the pair of side frame portions 10 and 10; in which a crossbar 7 is provided between the other end portion of such pair of side frame portions 10 and 10; and in which the first crossbar 11 is provided between both members. In the second crossbar 12, there is integrally linked the tongue piece 6 structuring one portion of the front surface of the buckle. The tongue piece 6 protrudes in the direction of separating from the first crossbar 11. Also, the protruding edge thereof structures one portion of the external outline of the buckle. In a bar outer surface of the crossbar 7, there are integrally linked the right-and-left pair of elastic latch-engaging legs 30 and 30, and a base portion of the middle leg 31. Since the rest of the structure of the buckle according to the second embodiment is substantively the same as that of the buckle according to the first embodiment, regarding the substantively same structural portions, the same reference numerals used in each drawing of the first embodiment are assigned to each drawing of the second embodiment, and explanations thereof are omitted.

Third Embodiment

In the third embodiment shown in FIGS. 9 and 10, the buckle respectively disposes crossbars 8 and 20 between both ends of the pair of side frame portions 10 and 10, and comprises square-shaped frame-like portion which is formed by the pair of side frame portions 10 and 10, and the pair of crossbars 8 and 20. One of the pair of crossbars 8 and 20 functions as the attachment portion 2.

The first crossbar 11 and the second crossbar 12 are disposed between such pair of crossbars 8 and 20, and between the pair of side frame portions 10 and 10. The first crossbar 11 is positioned on a side of the attachment portion 2.

Even in this example, in the pair of side frame portions 10 and 10, there are respectively formed the axis holes 10*c* rotatably housing the base end portions 40 of the clamping member 4. The axis holes 10*c* are open in frame inside surfaces of the side frame portions 10. Also, the axis holes 10*c* are located near linkage portions between the side frame portions 10 and the crossbar which does not become the attachment portion 2, and are formed in the back surface side Bw of the buckle.

The clamping member 4 is rotatably combined with the side frame portions 10 by inserting one base end portion 40, which protrudes to the outside from the terminals of the intermediate portions 42, into one axis hole 10*c* of the pair of side frame portions 10 and 10 from an inside of the side frame portion 10; and by inserting the other base end portion 40, which protrudes to the outside from the terminals of the intermediate portions 42, into the other axis hole 10*c* of the pair of side frame portions 10 and 10 from the inside of the side frame portion 10. In the example, in a state before the clamping member 4 is combined with the side frame portions 10, an interval between outer surfaces of the pair of intermediate portions 42 and 42 of the clamping member 4 approximately corresponds to an interval between the frame inside surfaces of the pair of side frame portions 10 and 10. Therefore, such combination is carried out while generating the elastic deformation in the clamping member 4 in a direction of narrowing the interval between the pair of intermediate portions 42 and 42 of the clamping member 4.

Also, in the example, the protruding portions 50 structuring the aforementioned holding devices 5 are respectively formed in the frame inside surfaces 10*h* of the pair of side frame portions 10 and 10. In the illustrated example, such protruding portions 50 are formed in a portion which is between the second crossbar 12 and the crossbar 8 which does not become the attachment portion 2 in the side frame portions 10. Also, such protruding portions 50 are structured in such a way as to form the fin shape protruding in a direction orthogonal to the frame inside surfaces 10*h* along corner portions between the frame front surface 10*e* structuring one portion of the front surface of the buckle and the frame inside surfaces 10*h* of the side frame portions 10.

In the example, in the first rotating position wherein the free end portion 41 of the clamping member 4 sandwiches the belt-like body W between the free end portion 41 and the bar front surface 11*a* of the first crossbar 11, the intermediate portions 42 of the clamping member 4 are positioned under a back surface of the protruding portions 50. (FIG. 10) From this state, when the clamping member 4 is rotated in the direction wherein the free end portion 41 is separated from the first crossbar 11, the intermediate portions 42 are pressed by the protruding portions 50, so that the clamping member 4 is elastically deformed in the direction of narrowing the interval between the pair of intermediate portions 42 and 42. From this state, when the clamping member 4 is rotated up to the position wherein the intermediate portions 42 climb over the protruding ends 50*b* of the protruding portions 50, the clamping member 4 is elastically returned in the direction of expanding the interval between the pair of intermediate portions 42 and 42, so that the clamping member 4 is forcedly rotated up to the rotating position (shown by imaginary lines in FIG. 10) clamping the intermediate portions 42 between the protruding portions 50 and the crossbar 8 which does not become the attachment portion 2.

Since the rest of the structure of the buckle according to the third embodiment is substantively the same as that of the buckle according to the first embodiment, regarding the substantively same structural portions, the same reference numerals used in each drawing of the first embodiment are assigned to each drawing of the third embodiment, and explanations thereof are omitted.

Fourth Embodiment

In the fourth embodiment shown in FIGS. 11 to 13, the buckle respectively disposes the crossbars 8 and 20 between both ends of the pair of side frame portions 10 and 10, and comprises the square-shaped frame-like portion which is formed by the pair of side frame portions 10 and 10, and the pair of crossbars. One of the pair of crossbars 8 and 20 functions as the attachment portion 2.

The first crossbar 11 and the second crossbar 12 are disposed between such pair of crossbars 8 and 20, and between the pair of side frame portions 10 and 10. The first crossbar 11 is positioned on the side of the attachment portion 2.

In the example, the clamping member 4 is structured by molding the wire material in such a way as to comprise the pair of intermediate portions 42 and 42 respectively comprising the base end portions 40, and the free end portion 41 ranged between the pair of intermediate portions 42 and 42, and in such a way that the intermediate portions 42 further comprise winding portions 43. In the illustrated example, the winding portions 43 for one rotational portion are respectively formed in the terminals of the pair of intermediate portions 42 and 42. A winding axis line of the winding portions 43 is approximately parallel to the free end portion 41 and the base end portions 40.

Also, the holding devices 5 are structured as supporting portions 51 of the winding portions 43 provided in the side frame portions 10, and supporting the winding portions 43 at a position different from the base end portions 40 of the wire material. In the illustrated example, such supporting portions 51 are structured as axial projections protruding from the frame inside surfaces 10*h* of the side frame portions 10, and are inserted to pass through the winding portions 43.

In the example, in the pair of side frame portions 10 and 10, there are respectively formed the axis holes 10*c* rotatably housing the base end portions 40 of the clamping member 4. The axis holes 10*c* are open in the frame inside surfaces 10*h* and the outside surfaces 10*d* of the side frame portions 10. The axis holes 10*c* and the supporting portions 51 are provided between the second crossbar 12 and the crossbar 8 which does not become the attachment portion 2. The supporting portions 51 are positioned on the second crossbar 12 side rather than the axis holes 10*c*.

The clamping member 4 is rotatably combined with the side frame portions 10 in such a way that one base end portion 40, which protrudes to the outside from the terminals of the intermediate portions 42, is inserted into one axis hole 10*c* of the pair of side frame portions 10 and 10 from the inside of the side frame portion 10, and that the other base end portion 40, which protrudes to the outside from the terminals of the intermediate portions 42, is inserted into the other axis hole 10*c* of the pair of side frame portions 10 and 10 from the inside of the side frame portion 10. Also, the clamping member 4 is rotatably combined with the side frame portions 10 in such a way that one supporting portion 51 of the pair of side frame portions 10 and 10 is inserted to pass through the winding portion 43 of one intermediate portion 42, and that the other supporting portion 51 of the pair of side frame portions 10 and is inserted to pass through the winding portion 43 of the other intermediate portion 42. Then, when the clamping member 4 is rotated in the direction wherein the free end portion 41 is separated from the first crossbar 11 from the first rotating position wherein the free end portion 41 of the clamping member 4 sandwiches the belt-like body W between the free end portion 41 and the bar front surface of the first crossbar 11, the winding portions 43 are structured to elastically deform.

Thereby, in the example, a state wherein the free end portion 41 of the clamping member 4 sandwiches the belt-like body W between the free end portion 41 and the bar front surface 11*a* of the first crossbar 11 is not easily released. (FIG. 13) The change of the fastening position of the buckle relative to the belt-like body W is carried out by rotating in the direction wherein the free end portion 41 is separated from the first crossbar 11 while elastically deforming the winding portions 43 of the clamping member 4.

Since the rest of the structure of the buckle according to the fourth embodiment is substantively the same as that of the buckle according to the first embodiment, regarding the substantively same structural portions, the same reference numerals used in each drawing of the first embodiment are assigned to each drawing of the fourth embodiment, and explanations thereof are omitted.

Other

In the first to third embodiments, although the protruding portions 50 which become the holding devices 5 are respectively provided on both of the pair of side frame portions 10 and 10, the projecting portions 50 may be provided only in one of the pair of side frame portions 10 and 10.

Also, if a surface of the free end portion 41 of the clamping member 4 explained above has a rough surface, a friction resistance between the free end portion 41 and the belt-like body W in the first rotating position can increase so as to be capable of improving the sandwiched state of the belt-like body W in the first rotating position.

All contents of the specification, claims, drawings, and abstract of Japanese Patent Applications No. 2010-013952 filed on Jan. 26, 2010 are cited in their entireties herein and are incorporated as a disclosure of the specification of the present invention.

What is claimed is:

1. A buckle, comprising:

a pair of side frame portions;

a first crossbar and a second crossbar extending between the pair of side frame portions, the first crossbar being adapted to be wound by a belt body; and a fastening portion located on the first crossbar of the buckle for fastening the belt body wound around the first crossbar, a clamping member rotatably supported in the side frame portions, and having a free end portion for clamping the belt body between the free end portion and the fastening portion of the first crossbar in a first position wherein the free end portion is most closely contacting with the first crossbar and releasing the belt body in a second position wherein the free end portion is separated from the first crossbar; and a holding device for deforming the clamping member when the clamping member receives a rotation force in a direction of separating the free end portion from the first crossbar, wherein the holding device is a protruding portion formed on each of the side frame portions, and having a first taper portion directed toward the first crossbar, a second taper portion directed toward the second crossbar, and a protruding end protruding furthest from an outside surface of the side frame portion and disposed between the first and second taper portions, and the protruding portion abuts against a side portion of the clamping member so that when the clamping member rotates from the second position to the first position, the clamping member elastically deforms to slide over the protruding end and the first taper portion urges the clamping member to press the free end portion against the belt body, and when the clamping member rotates from the first position to the second position, then clamping member elastically deforms to slide over the protruding end and the second taper portion forces the clamping member to rotate in the direction of separating from the first crossbar.

2. A buckle according to claim 1, wherein the clamping member has base end portions axially supported by the side frame portions, and is structured from a wire material abutting against the holding device at an intermediate portion between one base end portion and the free end portion.

3. A buckle according to claim 2, wherein the clamping member is structured from the wire material including a pair of intermediate portions respectively having the base end portions, and the free end portion extending between the pair of intermediate portions.

4. A buckle according to claim 1, wherein a surface of the free end portion of the clamping member has a rough surface.

5. A buckle according to claim 1, further comprises an attachment portion extending between the pair of side frame portions and disposed on a side opposite of the second crossbar to arrange the first crossbar between the attachment portion and the second crossbar, the attachment portion being adapted to be wound around another belt body.

6. A buckle according to claim 5, wherein the pair of side frame portions comprises axis holes arranged adjacent to the second crossbar and rotatably housing the clamping member, so that when the clamping member rotates from the first position to the second position, the free end portion of the clamping member moves from a position above the first crossbar toward the second crossbar in which the free end portion moves above and over the second crossbar.

7. A buckle according to claim 6, wherein the clamping member comprises a pair of intermediate portions each extending inwardly from each end of the free end portion to gradually approach the other intermediate portion.

* * * * *